US006939286B1

(12) United States Patent
Hurdlow

(10) Patent No.: US 6,939,286 B1
(45) Date of Patent: Sep. 6, 2005

(54) CENTRIFUGE FOR PHASE SEPARATION

(75) Inventor: Elman Dail Hurdlow, Sequim, WA (US)

(73) Assignee: Archon Technologies Inc., Chesapeake, VA (US)

( * ) Notice: Subject to any disclaimer, the term of this patent is extended or adjusted under 35 U.S.C. 154(b) by 0 days.

(21) Appl. No.: 10/135,154

(22) Filed: Apr. 29, 2002

(51) Int. Cl.[7] ..... B04B 1/04; B04B 11/00
(52) U.S. Cl. ..... 494/56; 494/66; 494/68; 494/79
(58) Field of Search ..... 494/36, 43, 56, 494/66, 79, 80, 68; 210/360.1, 380.1

(56) References Cited

U.S. PATENT DOCUMENTS 2,538,529 A * 1/1951 Komline ..... 494/56
2,688,437 A * 9/1954 Monnet ..... 494/26
3,823,869 A * 7/1974 Loison ..... 494/56
3,955,758 A * 5/1976 Loison ..... 494/56
4,353,499 A * 10/1982 Simonds ..... 494/68
5,338,284 A * 8/1994 Knelson ..... 494/56
5,462,513 A * 10/1995 McAlister ..... 494/56
5,586,965 A * 12/1996 Knelson ..... 494/56
5,601,523 A * 2/1997 Knelson ..... 494/56
5,601,524 A * 2/1997 Knelson ..... 494/80
6,312,610 B1 * 11/2001 Kirker et al. ..... 210/380.1

FOREIGN PATENT DOCUMENTS

WO 98/08611 * 3/1998

* cited by examiner

*Primary Examiner*—Charles E. Cooley
(74) *Attorney, Agent, or Firm*—Archon Technologies Inc.

(57) ABSTRACT

An imperforate bowl centrifuge for phase separation employing a rotatable outer cylinder having an interior wall with a plurality of indentations each with an orifice, and an outer wall with heavy phase waste routing channels leading from the orifices to a waste control valve. Separated heavy phase particles collect in the channels and flow by force of pressure, and exit through the waste control valve at one end of the outer cylinder when it is opened to release the waste. An outlet for the separated light phase fluid is disposed at another end of the outer cylinder. The channels in the outer wall may be axially or angularly disposed to force the separated heavy phase toward the waste control valve.

8 Claims, 4 Drawing Sheets

CENTRIFUGE FOR PHASE SEPARATION

BACKGROUND OF THE INVENTION

Traditional phase separation devices, such as tubal, decanter and cone centrifuges have been used for various separation tasks, including those in medicine and pharmaceutical production, and wastewater treatment. Selection of the type of separation devices has depended upon such factors as residence time desired, size of waste particles, G force required to effect separation, and tolerances for such factors as interrupted use to clean system, noise, vibration, wear, energy use and maintenance.

More recently, U.S. Pat. No. 6,312,610 disclosed a density screening device employing a thick-shelled outer cylinder wall having a series of indentations, each of which leads to a nozzle or opening that penetrates the outer wall of the outer cylinder. Through the openings, the continuous, non-mechanically assisted accumulation and ejection of heavy particle waste occurs along the entirety of the centrifugal device. The waste is collected by an exterior, non-rotating catchment cylinder or similar device in which the outer cylinder resides and rotates. The heavier waste materials accumulate on the stationary catchment cylinder wall and merely drip downwards at normal earth gravity, without further opportunity for recovery.

SUMMARY OF THE INVENTION

An object of the present invention, therefore, is to provide a centrifugal density screening device with waste release controls to improve recovery ratio of the effluent. This is accomplished by controlling the pressure and forces on the waste material.

A further object of the invention is to provide channels in which to collect waste material for release at selected, desired intervals.

Another object of the invention is to provide a centrifugal density screening device with multiple waste release mechanisms for filtering different areas of the device separately.

The objects of the invention are accomplished by providing a centrifuge filter for phase separation employing an outer cylinder having an interior wall with a plurality of indentations each with an orifice, and an outer wall with channels leading from an orifice to a waste control valve. Heavy particles collect in the channels and flow by force of pressure, and exit through a waste control valve when it is opened to release the waste.

DETAILED DESCRIPTION OF THE DRAWINGS

The present invention is a fluid separator for solids in which an outer cylinder has an interior wall with a plurality of indentations, the indentations each having an orifice, and further having an outer wall in which are set channels, each channel being in communication with and leading from an orifice to at least one waste control valve. An inner cylinder is arranged spatially within the outer cylinder. The inner cylinder has fins so as to form a fluid flow path between the exterior of the inner cylinder and the interior of the outer cylinder. Fluid enters through one end of the drum to entry ports and into the main body of a rotating system. The centrifugal forces created by the rotating system cause impurities to pass through the orifices in the indentations and into the waste routing channels positioned within the outer cylinder. The particles collect in the waste routing channel, flow by force of pressure into a rotating housing and exit through a waste control valve when it is opened to release the waste.

When the fluids containing suspended solids are subject to gravitational forces within a centrifuge, the elements having a higher specific gravity will tend to drop out of solution. The rate of dropout generally depends on a variety of factors including size of the particulate matter, the G forces to which they are subjected, the degree of difference of specific gravity between the particulate matter and the fluid, and the relationship the particulate matter shares with the surrounding fluid. The greater the G forces to which the fluid is subjected, the faster the elements having the heavier specific gravity will separate and gradate themselves. In this manner, the heaviest elements in the waste flow of the present invention gravitate away from the spinning axis of the rotating housing and displace the lighter elements within the waste routing channel, forcing the lighter elements back toward the spinning axis and the fluid flow channels. The effluent, therefore, becomes more concentrated as time elapses in the system of the present invention, resulting in an improved recovery ratio due to this displacement. The waste control valves may be opened periodically to release impurities as needed or as desired. An outer cylinder surrounds the inner cylinder to contain waste and direct the waste to one or multiple waste control valves where it can be collected and removed.

Figure 1:
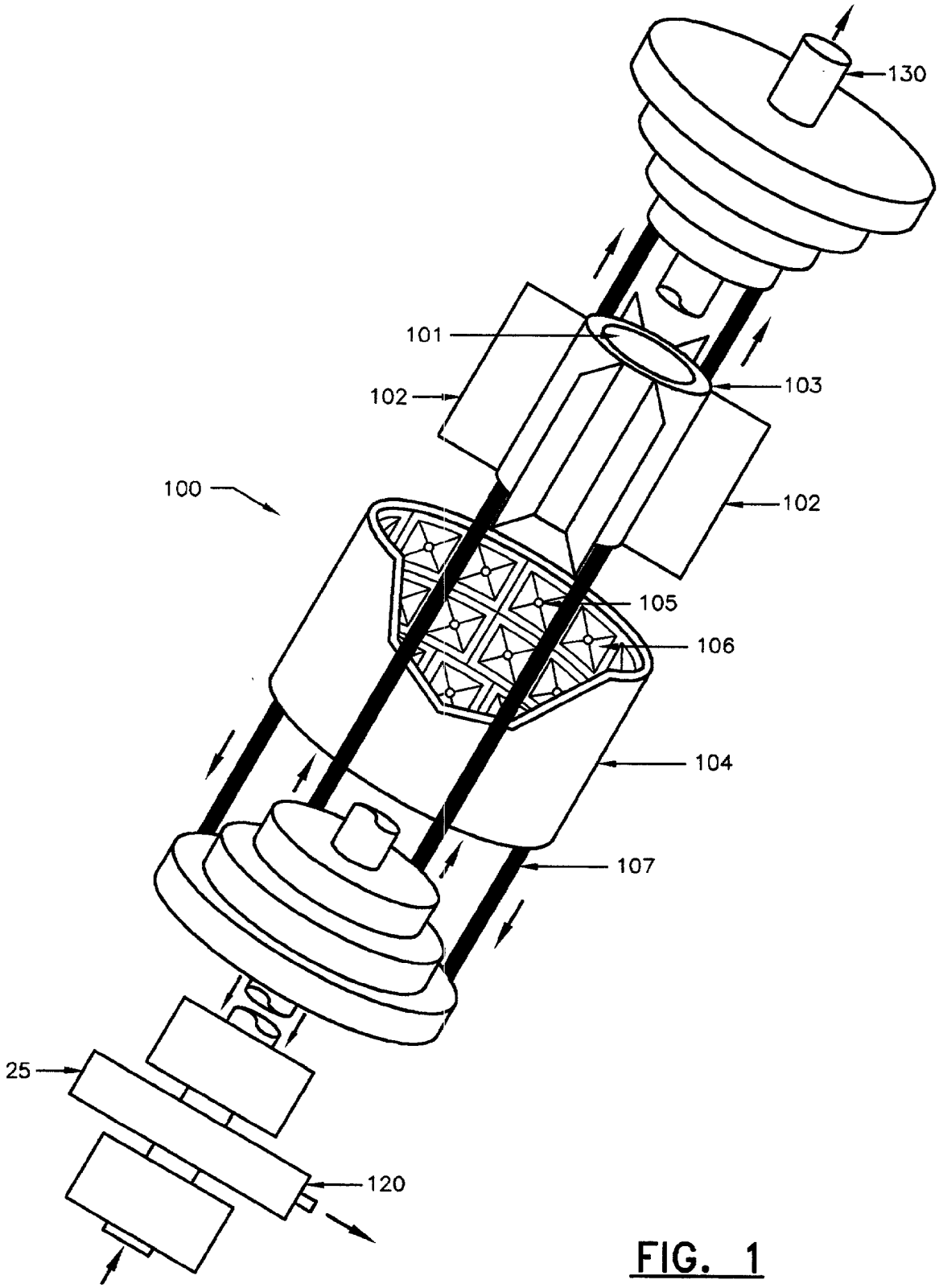
FIG. 1 is an exploded view of the system.

In FIG. 1, flow channels 101, created by spaces between projections such as fins 102 extending outward from an inner cylinder 103, receive fluid, such that the fluid passes between the outer cylinder 104 and the inner cylinder 103. The rotatable outer cylinder has an imperforate outer wall and defines an axis. A continuous fluid flow is created by the fins 102 to minimize fluid from mixing between flow channels 101. The heavy phase waste passes through orifices 105 in indentations 106 located on the interior surface of the outer cylinder 104 and into the axially disposed waste routing channels 107 located within the outer cylinder 104. The waste flows by force of pressure and exits through exit ports 240 (FIG. 2*b*) to a waste flow control valve 120 in a stationary housing 125. The circumferentially spaced indentations 106 may be aligned or situated in such a way as to provide offset intervals for filtering different areas of the device separately. The different areas may be filtered simultaneously or individually, and at differing or identical rates. The filtered light phase fluid exits through an outlet port 130. A filtered-fluid-flow-control valve may be provided for the outlet port 130.

Figure 2A:
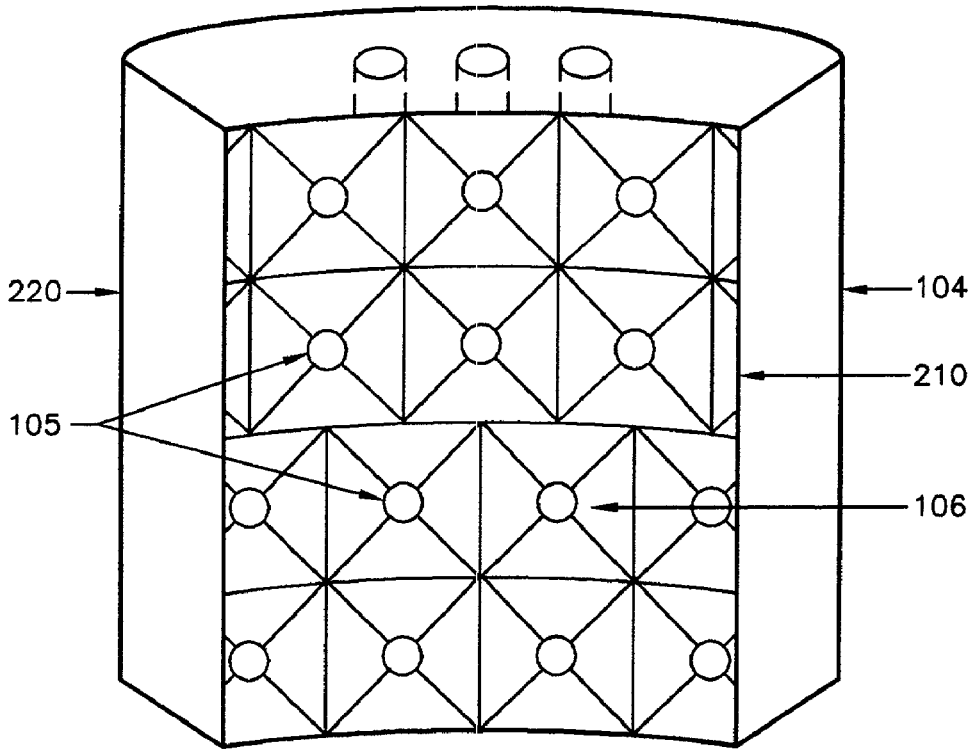
FIG. 2*a* is a sectional view of the outer cylinder.

In FIG. 2*a*, a cutaway of the outer cylinder 104 shows the indentations 106 and the orifices 105 in the inner wall 210 of the outer cylinder 104.

Figure 2B:
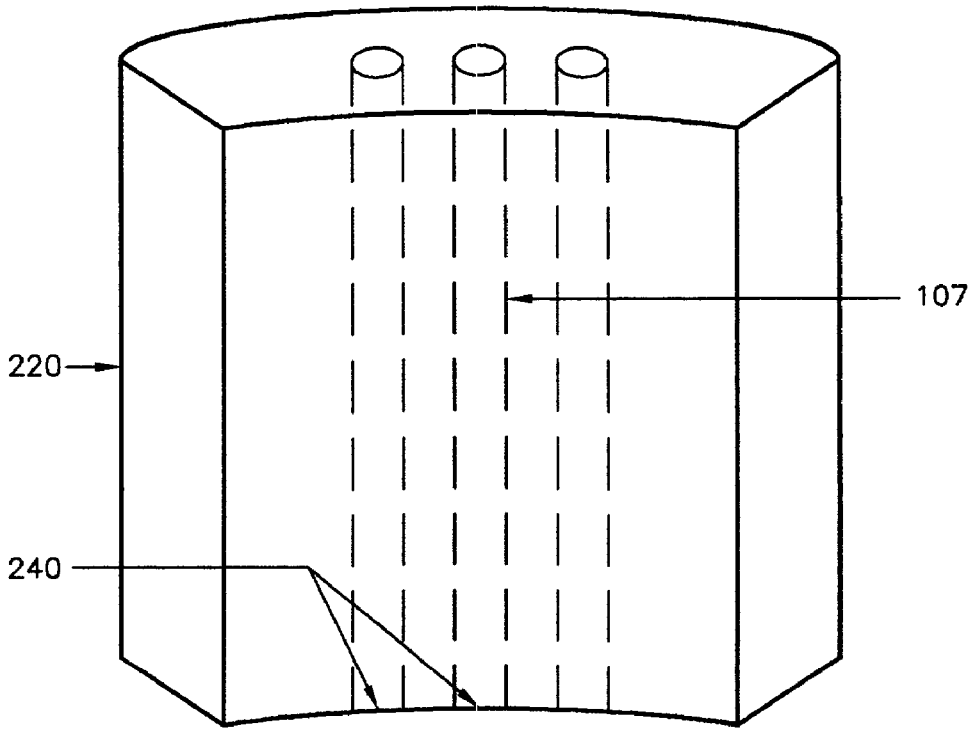
FIG. 2*b* is a cut away view of the interior wall of the outer cylinder.

In FIG. 2*b*, waste material passes through the orifices 105 into the axially disposed waste routing channels 107 in the outer wall 220 of the outer cylinder 104 to the exit ports 240.

The speed at which abrasive particulate material may pass through the orifices 105 may be greatly reduced, thereby minimizing the abrasion that occurs at the orifice 105, and diminishing the need for abrasion-resistant nozzles to protect the orifice. In previously known devices, the size of a passage for separation of particulate matter from the fluid flow must be large enough so as not to lose effectiveness by a build-up of material that can clog the passage. Too large a passage, however, reduces the recovery since fluid is lost through the passage, along with the particulate matter. In the present invention, fluid that passes through the orifice may be recovered once the particulate matter accumulated in the waste routing channel displaces the fluid back into the fluid flow channels. This is controlled by controlling the opening of the waste flow valves. The reduction in abrasion achieved with the present invention permits an embodiment in which the inner wall 210 of the outer cylinder 104 to be made of plastics, such that the indentations 106 and orifices 105 are of plastic, while the outer wall 220 of the outer cylinder 104 may be metal or the like. This embodiment of mixed material of the outer cylinder allows for a lighter device, therefore reducing the power requirement for operation. Additionally, it may lower production and maintenance costs.

Figure 3:
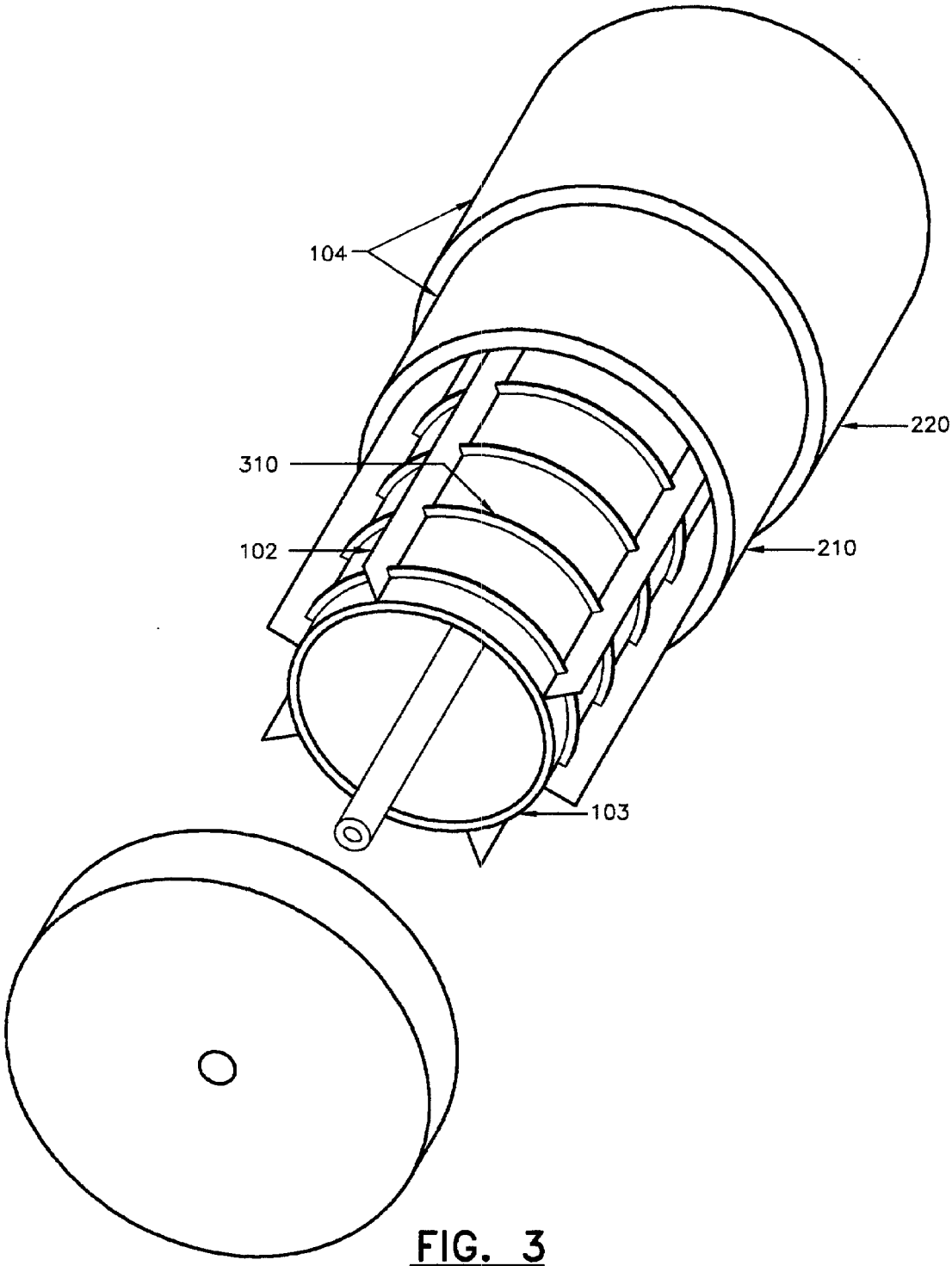
FIG. 3 is a partially exploded view of the outer and inner cylinders.

In FIG. 3, an embodiment having an outer cylinder 104 of mixed material in this fashion eliminates an excessive amount of weight and reduces the power requirements to operate the system. The inner wall 210 may be made of plastic material that is less expensive than the previously-used metal materials, and may be fabricated such that the outer cylinder 104 is comprised of two or more parts, the plastic inner wall portion 210 of the outer cylinder 104 being replaceable, thereby reducing down time when repairs are needed. The two or more parts of the outer cylinder 104 will form adjacent sections of the outer cylinder 104 to form the outer cylinder 104 having inner wall 210 and outer wall 220.

Inner cylinder 103 has fins 102 for creating flow channels, and may additionally have other projections such as ribs 310 for routing the flow of fluid in the flow channels to increase the residence time. The ribs 310 and fins 102 may be arranged in various configurations and may be angled to the fins 102 at various degrees to maximize the efficiency of the flow.

Further benefits arise from control of the waste removal through the waste routing channels 107. Differing materials when concentrated, and the degree to which they are concentrated, take on specific characteristics. For heavily concentrated material, an increase in force is needed to expel the material from the waste routing channels 107 additionally so in circumstances where higher G forces are being exerted on the material at the time of expulsion. In the present invention, the expulsion force is supplied in the form of an internal drum pressure, such as may be obtained from a supply pump or an auxiliary source plumbed to the system. In one embodiment, the orientation of the waste flow control valve 120 may supply additional force for expelling effluent.

Pressure within the system can be varied to effect purging of waste material from the system. Since different materials have different characteristics when subject to varied G forces, controlling the amount of pressure within the system assists in creating sufficient force to expel the waste material out of the system. The amount of force or pressure required depends on the desired viscosity of the concentrated waste and the G force to which the material is subjected. The desired viscosity is in turn controlled by how often the system is purged. Pressures may range from about 10 psi to about 10,000 psi. The speed of the system can also be adjusted during the purging process to accommodate expulsion of waste material. The waste routing channels 107 and the waste flow control valve 120 are positioned so as to assist in moving waste material out of the system.

Figure 4:
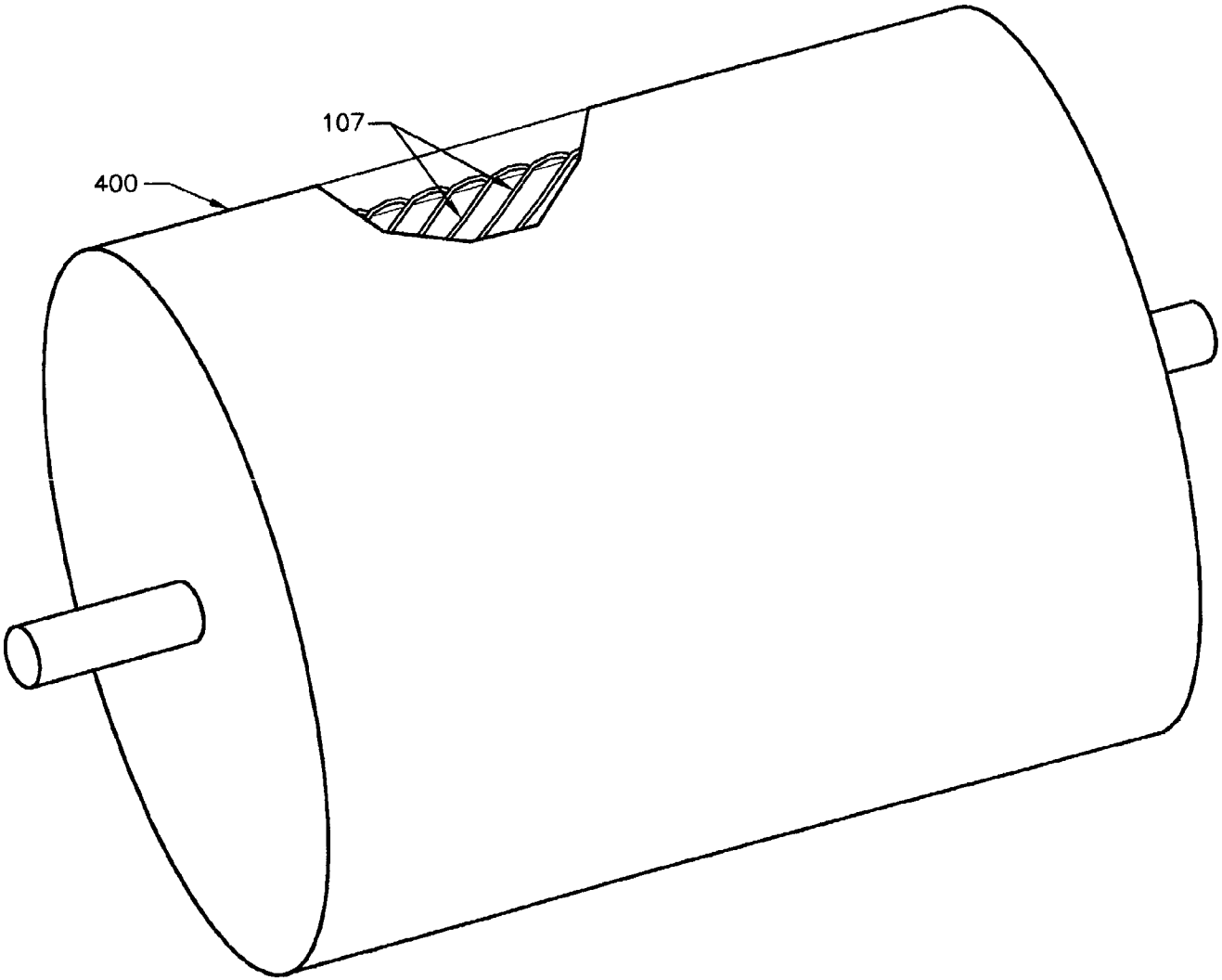
FIG. 4 is a partially cut away view of the outer and inner cylinders.

In FIG. 4, the waste routing channels 107 are acutely angled at the orifices in the outer cylinder 400. This orientation provides additional force to move the particulate matter toward the waste flow control valve. The embodiment of FIG. 4 further shows that the waste routing channels may be configured so as to route the particulate matter toward either end of the device.

The length and diameter of both the outer cylinder 104 and the inner cylinder 103 can be sized to meet different flow demands. If a large flow rate is required, the diameter and length of both cylinders can be increased so that the volume of fluid within the system is increased. The increased volume allows for a higher flow rate through the system while maintaining a residence time that can efficiently clean the fluid. In a system having smaller cylinder diameters and lengths, the fluid will also be cleaned, but the flow rate through the system will be reduced and the speed of rotation will be required to be higher to achieve the desired residence time to G force ratio.

Speed of rotation can be varied to obtain the G forces necessary to clean the fluid. The desired speed is associated with the diameters of the cylinders. Since some fluids require greater G forces to effect cleansing than do others, the volume to be filtered and the G forces required for filtering will factor in the size of the system selected.

The size of the orifice in the indentation can be varied in diameter to accommodate the size of particulate matter in the fluid being filtered. The size of the orifices may range from about 1/64 inch to about 1/2 inch in diameter, selected based upon the size of the particulate matter to be removed from the fluid. Various sizes of the orifice are possible, since the orifices are in communication with the waste routing channel, which in turn leads to a waste control flow valve. This orientation permits filtering of different portions of the cylinder simultaneously or at differing intervals to improve efficiency of the system.

The invention having been depicted and described in detail herein, it will be apparent to those skilled in the relevant art that various modifications, additions, substitutions and the like can be made without departing from the spirit of the invention and these are therefore considered to be within the scope of the invention as defined the claims that follow.

What is claimed is:

1. A centrifuge for phase separation comprising:

a rotatable outer cylinder defining an axis, said outer cylinder having an imperforate outer wall, an interior wall with a plurality of circumferentially spaced indentations, the indentations each having an orifice, the outer cylinder having axially disposed routing channels for a separated heavy phase in communication with and leading from said orifices to a waste control valve disposed in a stationary housing adjacent one end of said outer cylinder;

an inner cylinder disposed within outer cylinder, said inner cylinder having projections defining flow channels within said outer cylinder;

an outlet for a separated light phase disposed at another end of said outer cylinder.

2. A centrifuge as claimed in claim 1 wherein said projections are fins extending from said inner cylinder.

3. A centrifuge as claimed in claim 2, wherein said projections further comprise ribs extending from said inner cylinder and disposed at angle to said fins.

4. A centrifuge as claimed in claim 1 wherein the plurality of indentations are arranged in axially offset intervals.

5. A centrifuge as claimed in claim 1 wherein the outer cylinder comprises at least two adjacent sections.

6. A centrifuge as claimed in claim 5 wherein the at least two adjacent sections comprise an inner wall portion and an outer wall portion.

7. A centrifuge as claimed in claim 6 wherein the inner wall portion is plastic and the outer wall portion is metal.

8. A centrifuge for phase separation comprising:

a rotatable outer cylinder defining an axis, said outer cylinder having an imperforate outer wall, an interior wall with a plurality of circumferentially spaced indentations, the indentations each having an orifice, the outer cylinder having routing channels for a separated heavy phase in communication with and leading from said orifices to a waste control valve disposed in a stationary housing adjacent one end of said outer cylinder, said routing channels being disposed at an acute angle to force the separated heavy phase toward said waste control valve;

an inner cylinder disposed within outer cylinder, said inner cylinder having projections defining flow channels within said outer cylinder; an outlet for a separated light phase disposed at another end of said outer cylinder.

* * * * *